US005964582A

United States Patent [19]

Kobayashi et al.

[11] Patent Number: 5,964,582

[45] Date of Patent: Oct. 12, 1999

[54] FRAGMENT PREVENTION AND CONTAINMENT FOR A BEARING DEVICE FOR USE IN A PUMP

[75] Inventors: Makoto Kobayashi; Masakazu Yamamoto; Yoshio Miyake; Koji Isemoto; Keita Uwai; Yoshiaki Miyazaki, all of Fujisawa, Japan

[73] Assignee: Ebara Corporation, Tokyo, Japan

[21] Appl. No.: 09/073,194

[22] Filed: May 6, 1998

Related U.S. Application Data

[63] Continuation of application No. 08/579,247, Dec. 27, 1995, abandoned.

[30] Foreign Application Priority Data

Dec. 27, 1994 [JP] Japan ..... 6-337846

[51] Int. Cl.[6] ..... F04B 17/00

[52] U.S. Cl. ..... 417/423.12; 417/423.13; 415/229; 384/297; 384/907.1

[58] Field of Search ..... 417/423.12, 423.13, 417/423.5; 415/111, 229, 121.2; 416/244 R, 204 R; 384/215, 220, 222, 295, 297, 907.1

[56] References Cited

U.S. PATENT DOCUMENTS

| | | | |
|---|---|---|---|
| 4,832,659 | 5/1989 | Nelson | 464/178 |
| 5,302,091 | 4/1994 | Horiuchi | 415/229 |
| 5,567,133 | 10/1996 | Kobayashi et al. | 417/423.7 |
| 5,582,371 | 12/1996 | Humphrey et al. | 246/453 |

*Primary Examiner*—Timothy S. Thorpe
*Assistant Examiner*—Cheryl J. Tyler
*Attorney, Agent, or Firm*—Oblon, Spivak, McClelland, Maier & Neustadt, P.C.

[57] ABSTRACT

A bearing device for use in a pump which has a bearing member composed of a hard and brittle material made of ceramic such as silicon carbide (SiC). The bearing device has a bearing housing, a ceramic bearing member housed in the bearing housing and supporting a shaft, an elastic material around the ceramic bearing member for preventing the ceramic bearing member from being broken, and a thrust collar for preventing fragments of the ceramic bearing member from being scattered when the ceramic bearing member is broken.

24 Claims, 5 Drawing Sheets

FRAGMENT PREVENTION AND CONTAINMENT FOR A BEARING DEVICE FOR USE IN A PUMP

This a continuation of application Ser. No. 08/579,247, filed on Dec. 27, 1995 now abandoned.

BACKGROUND OF THE INVENTION

1. Field of the Invention

The present invention relates to a bearing device for use in a pump, and more particularly to a bearing device comprising a hard and brittle material which is typical of ceramics such as silicon carbide (SiC), and a pump equipped with such a bearing device.

2. Description of Related Art

There have been known pumps which use a bearing device incorporating a bearing member comprising a hard and brittle material made of ceramics such as SiC, for example, in Japanese laid-open patent publication No. 6-14491. The bearing device disclosed in Japanese laid-open patent publication No. 6-14491 has the following drawbacks.

(1) The bearing device is a self-lubricated type in which the pumped fluid lubricates the bearing member in the bearing device. Therefore, when the pump is operated in a condition of a shortage of water such as a case where a foot valve is in trouble at the time of suction operation, the bearing member is often damaged or broken because of poor lubrication. Further, concerning lubrication of the bearing member made of ceramics, a structural consideration has not been sufficiently made, thus air is liable to be accumulated at the sliding portion of the bearing member by a centrifugal separation, resulting in breakage of the bearing member.

(2) In the case where the pump incorporating the bearing device is used for pumping high temperature liquid, since a coefficient of linear thermal expansion of ceramics such as SiC is smaller than that of a main shaft made of martensitic stainless steel, a fastening force of a nut which is provided at the end portion of the main shaft to fix an impeller, the bearing member or the like to the main shaft is lowered, and the nut is loosened. As a result, the bearing member is loosened and does not work normally, resulting in breakage of the bearing member. In the disclosed structure, although a spring washer for preventing loosening of the above nut is provided, this method is not enough to achieve it.

(3) In case of breakage of the bearing member in the bearing device, fragments of ceramics such as SiC scattered in the pump may damage a can of a canned motor or other components, thus not only the bearing member but also other components must be replaced with a new one. Further, the fragments of ceramics are sometimes mixed in the pumped liquid such as drinking water.

(4) In case of breakage of the bearing member, according to the conventional method using a nut and a spring washer, the fastening force of the nut becomes zero, and the impeller falls off from the main shaft and fragments of ceramics are further widely scattered.

(5) In the disclosed structure, although a thrust bearing member is fixed by a pin made of elastic material, a function for preventing the thrust bearing member from rotating, with respect to a holding member is not sufficient. That is, there is no problem when the bearing member is lubricated normally by the pumped liquid, but in case of increase of sliding torque due to poor lubrication or adhesion between sliding members, the pin is cut off due to shearing force, resulting in malfunction of prevention of rotation. As a result, the thrust bearing member is loosened to thus be damaged or broken.

SUMMARY OF THE INVENTION

It is therefore an object of the present invention to provide a bearing device for use in a pump which is less susceptible to be broken and can eliminate a problem of secondary concern such as scattering of fragments even if it is broken. To be more specific, the objects of the present invention are as follows:

(1) The bearing member in the device is prevented from being broken by maintaining good lubrication of sliding surfaces, and even if it is broken, the pump incorporating such bearing device is prevented from being damaged.

(2) Ceramics such as SiC are prevented from being mixed in liquid handled by the pump.

(3) Repair is completed only by replacing the bearing member, and other components are not required to be repaired.

(4) The bearing member made of ceramics can be prevented from rotating, with respect to the holding member using a rotation preventing member made of elastic material.

Another object of the present invention is to provide a pump which incorporates the above bearing device.

According to one aspect of the present invention, there is provided a bearing device for use in a pump having a bearing assembly for supporting a rotating body, the rotating body having a shaft, comprising: a bearing housing; a stationary bearing member housed in the bearing housing and supporting the shaft; and at least one of first means for preventing the stationary bearing member from being broken, and second means for preventing fragments of the stationary bearing member from being scattered when the stationary bearing member is broken.

According to the present invention, since the bearing member made of ceramics such as SiC are enclosed by the bearing housing and the thrust collar, even if the bearing member is broken, fragments of ceramics are less susceptible to be scattered. Further, by inserting the thrust collar into the bearing housing, prevention of scattering fragments is further improved.

According to the present invention, since the bearing member is fixed to the main shaft using a dimension absorption member such as a spring washer and a double nut, even if the pump handles high temperature liquid, the bearing member is securely fixed to the main shaft. Even if the bearing member is broken, the double nut is less susceptible to be loosened, thus the bearing member is prevented from moving axially and being scattered around.

According to the present invention, a thrust collar is fixed to the main shaft and is in sliding contact with the stationary radial bearing member, and the thrust collar has a through hole introducing liquid in the pump into sliding surfaces of the stationary and rotatable radial bearing members. Therefore, the sliding surfaces can be sufficiently lubricated. In particular, even if the pump is vertically installed so that an axis of the main shaft extends vertically, air is not accumulated around the main shaft, and thus the bearing member is less susceptible to be broken.

The above and other objects, features, and advantages of the present invention will become apparent from the following description when taken in conjunction with the accompanying drawings which illustrate preferred embodiments of the present invention by way of examples.

DETAILED DESCRIPTION OF THE PREFERRED EMBODIMENTS

An embodiment of the present invention will be described below with reference to FIGS. 1 through 5.

Figure 1:
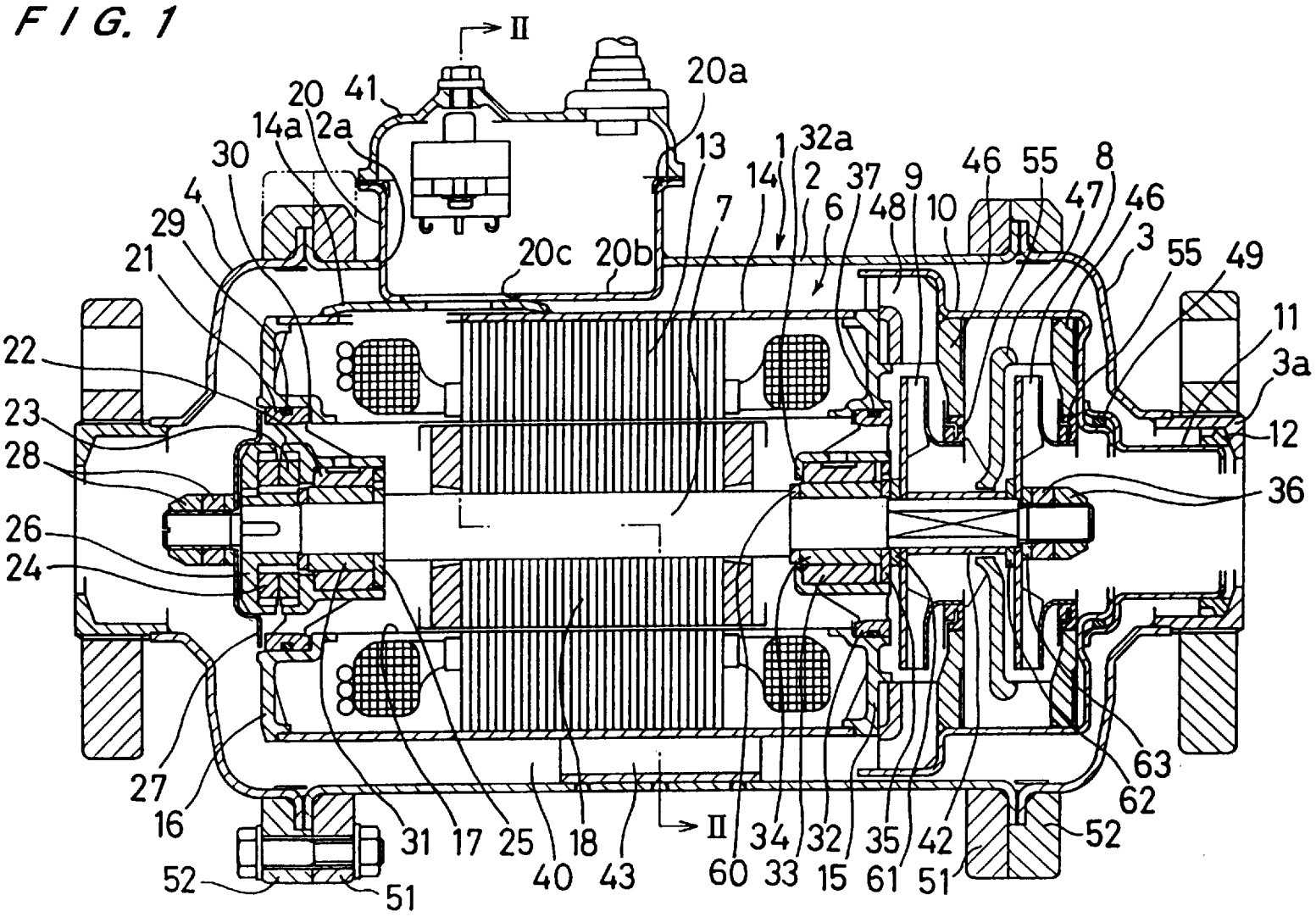
FIG. 1 is an axial cross-sectional view of a full-circumferential flow in-line pump which incorporate a bearing device according to an embodiment of the present invention.

FIG. 1 shows in cross section a full-circumferential flow in-line pump which incorporates a bearing device. As shown in FIG. 1, the full-circumferential flow pump comprises a pump casing 1, a canned motor 6 housed in the pump casing 1, impellers 8 and 9 fixed to a main shaft 7 of the canned motor 6. The pump casing 1 comprises an outer cylinder 2, a discharge-side casing 4 and a suction-side casing 3 connected to the respective ends of the outer cylinder 2 by flanges 51 and 52. The outer cylinder 2, the suction-side casing 3 and the discharge-side casing 4 are made of sheet metal such as stainless steel.

The first-stage impeller 8 and the second-stage impeller 9 are housed in a first inner casing 10. In the first inner casing 10, there are provided supporting members 46 having a liner ring 55 on the respective inner ends thereof, a return blade 47 for guiding fluid discharged from the first-stage impeller 8 towards the second-stage impeller 9, and a guide device 48 for guiding fluid discharged from the second-stage impeller from the radial direction towards the axial direction. A second inner casing 11 is connected to the suction-side of the first inner casing 10 with a resilient O-ring 49 interposed therebetween. A resilient seal 12 is interposed between the second inner casing 11 and a suction nozzle 3*a* of the suction-side casing 3.

The canned motor 6 includes a stator 13, an outer frame casing 14 fitted over the stator 13, side frame members 15, 16 welded to respective open ends of the outer frame casing 14, and a can 17 fitted in the stator 13 and welded to the side frame members 15, 16.

A rotor 18 is fixed to the main shaft 7. An annular space or passage 40 is defined between the outer frame casing 14 and the outer cylinder 2.

The outer cylinder 2 has a hole 2*a* in which a cable housing 20 is provided. The cable housing 20 is in the form of receptacle-like body having an open end 20*a* and a bottom 20*b*. The cable housing 20 is fixed at a hole 20*c* formed in the bottom 20*b* to the outer frame casing 14 by welding. The outer cylinder 2 and the cable housing 20 are hermetically welded together. An upper cover 41 is fixed to the cable housing 20.

The cable housing 20 is long in an axial direction of the canned motor and short in a circumferential direction of the canned motor, and the hole 20*c* for allowing leads of coils of the motor to pass therethrough is deviated from the center of the cable housing 20. Therefore, an area of the annular flow passage 40 is not reduced so much, and fluid loss caused by the cable housing 20 is prevented.

Figure 2:
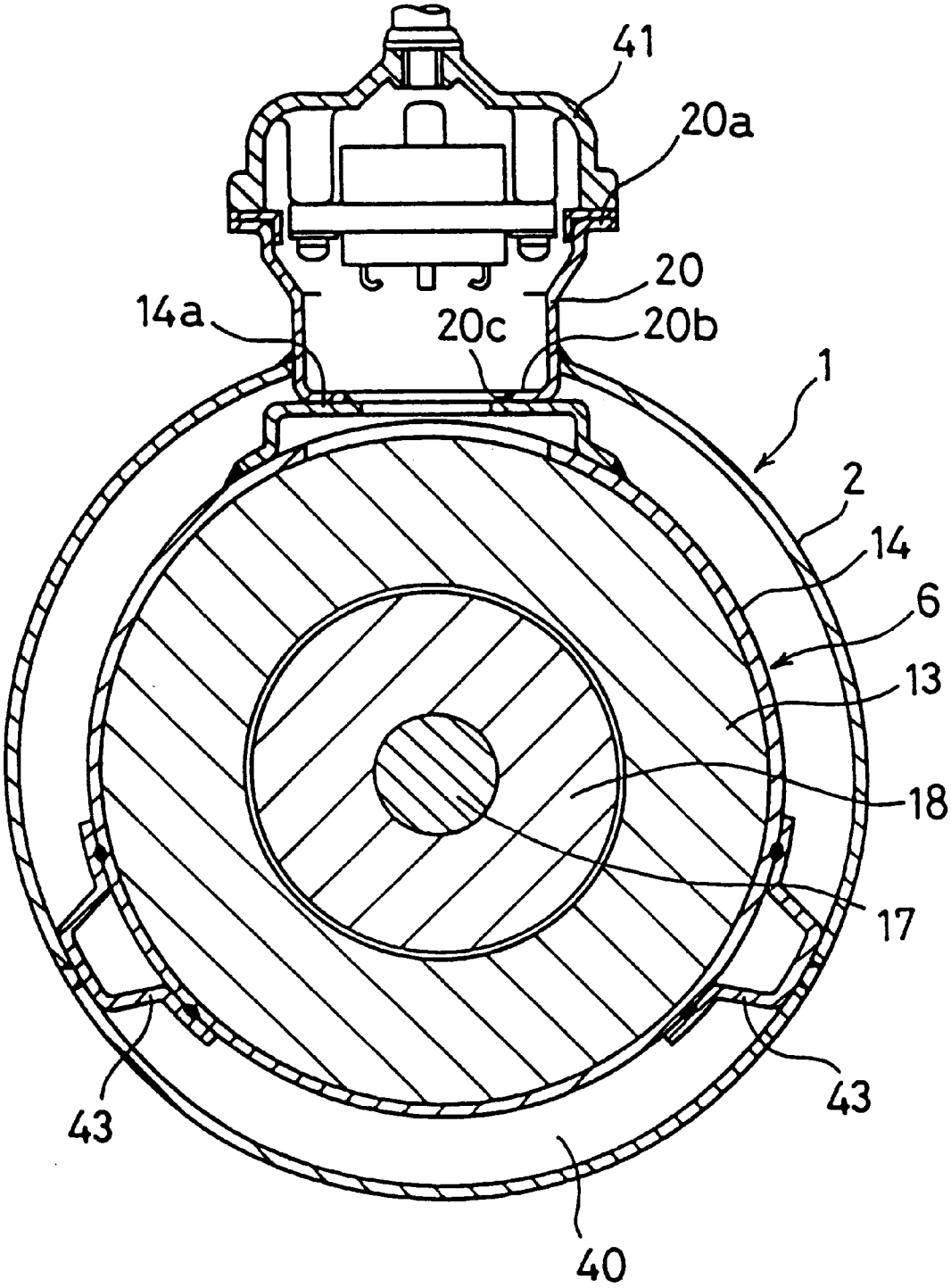
FIG. 2 is a cross-sectional view taken along line II—II of FIG. 1.

In this embodiment, as shown in FIG. 2, a seat member 14*a* is welded to the outer frame casing 14 at a position corresponding to the cable housing 20. The seat member 14*a* has a flat upper surface to which the cable housing 20 is attached by welding (see FIG. 2). Incidentally, the seat member 14*a* may be integrally formed on the outer frame casing 14 by press forming. The canned motor 6 and the outer cylinder 2 are integrally fixed to each other by the cable housing 20 and stays 43.

Figure 3:
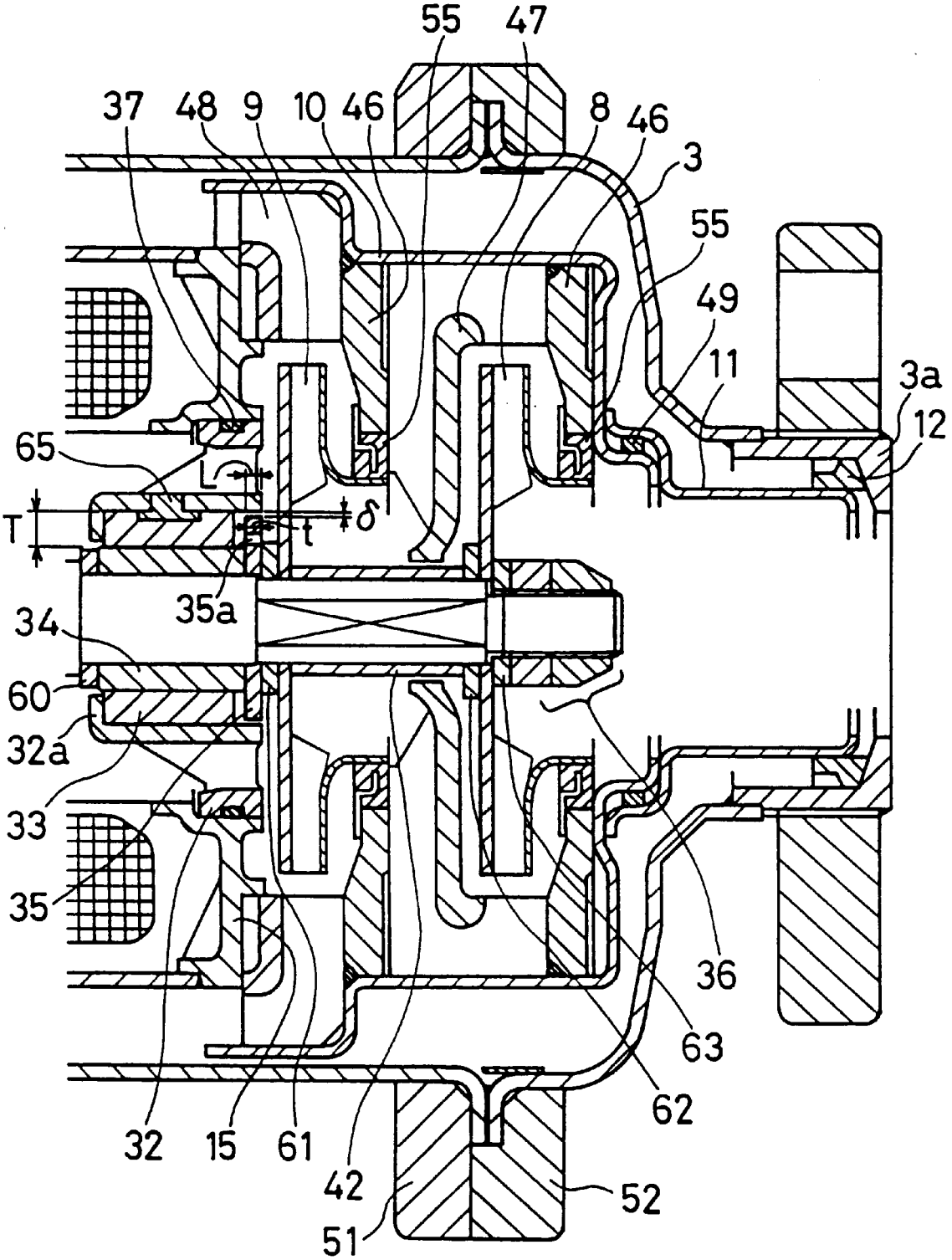
FIG. 3 is an enlarged cross-sectional view of the bearing device at the thrust load side and other components around the bearing device.

A bearing unit which supports the rotor assembly on a thrust load side, and components associated with such a bearing unit will be described below with reference to FIG. 3.

A stationary radial bearing member 33 made of silicon carbide (SiC) is mounted in a bearing housing 32. A rotatable radial bearing member 34 is fixed to the main shaft 7 so as to be rotatable integrally with the main shaft 7 and supported by the stationary radial bearing member 33, the rotatable radial bearing member 34 and the stationary radial bearing member 33 constituting a radial bearing assembly. The rotatable radial bearing member 34 is axially held against a thrust collar 35 which is fixed to the main shaft 7 through the impellers 8 and 9, a sleeve 42 and washer 61, 62, 63 by a threaded surface and a double nut 36 on the end of the main shaft 7.

The bearing housing 32 is inserted in a socket defined in the side frame member 15 with a resilient O-ring 37 interposed therebetween. The bearing housing 32 is held against the side frame member 15. A washer 60 is interposed between the main shaft 7 and the rotatable radial bearing member 34.

The bearing housing 32 has an end 32*a* which covers an end of the stationary radial bearing member 33. The thrust collar 35 is fixed to the main shaft 7 and positioned inside the bearing housing 32 which houses the stationary radial bearing member 33. The relationship between the radial clearance $\delta$ between the outer diameter of the thrust collar 35 and the inner diameter of the bearing housing 32 and the radial thickness T of the stationary radial bearing member 33 is arranged to be $\delta \leqq 0.5T$. That is, the radial clearance $\delta$ is arranged to be not more than a half of the radial thickness T of the stationary radial bearing member 33.

Further, the relationship between the axial thickness t of the thrust collar 35 and the distance L from the open end surface of the bearing housing 32 to the inner end of the thrust collar 35 is arranged to be $L \geqq 0.5t$. That is, the distance of not less than a half of thickness t of the thrust collar 35 is inserted into the bearing housing 32.

The thrust collar 35 has a through hole 35*a* extending axially by which the pumped liquid discharged from the impeller 9 is introduced into the sliding portion of the stationary radial bearing member 33 and the rotatable radial bearing member 34.

Figure 4:
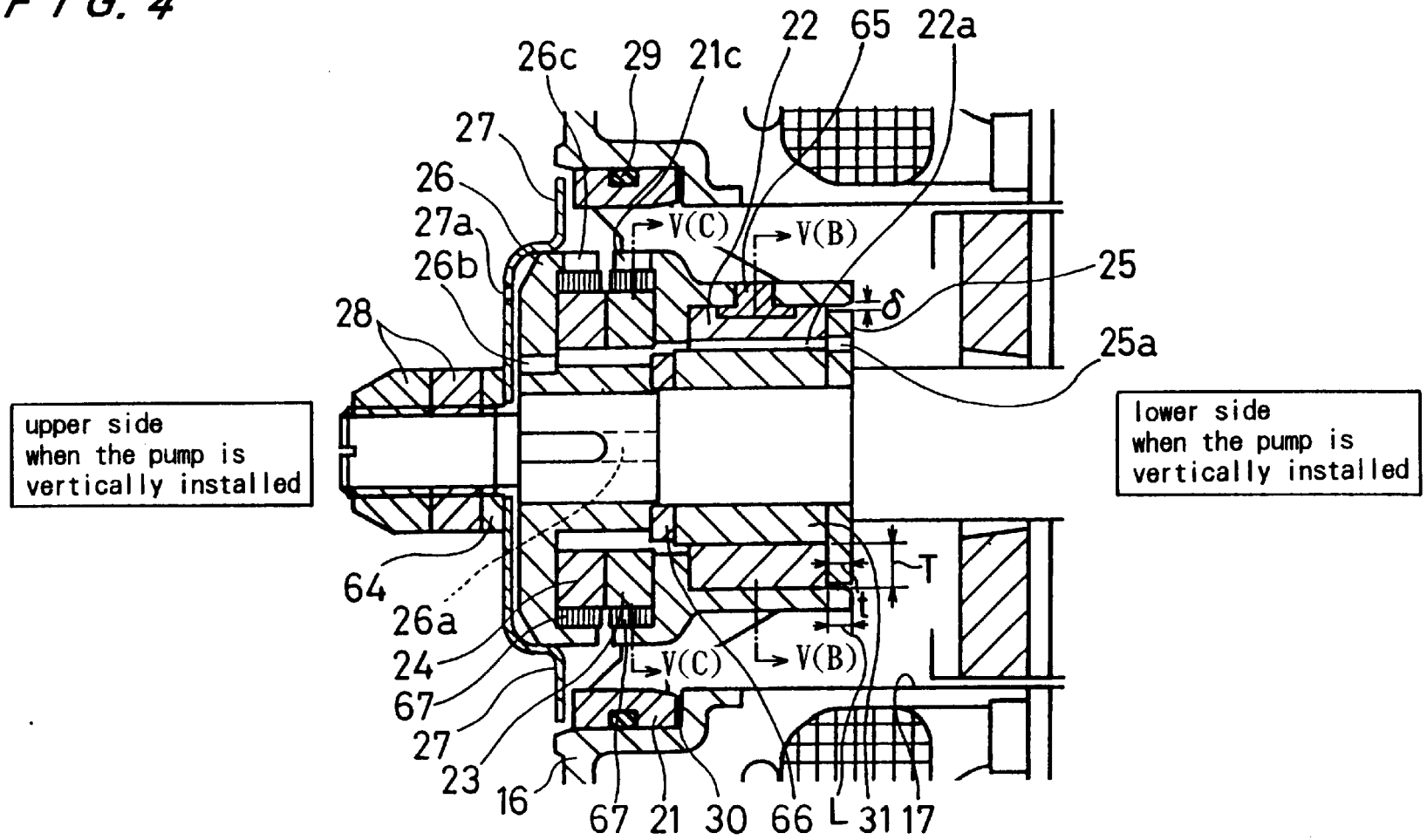
FIG. 4 is an enlarged cross-sectional view of the bearing device at the anti-thrust load side and other components around the bearing device.

A bearing unit which supports the rotor assembly on an anti-thrust load side, and components associated with such a bearing unit will be described below with reference to FIG. 4. FIG. 4 is a view of components in which the pump is vertically installed.

A stationary radial bearing member 22 made of SiC and a stationary thrust bearing member 23 made of SiC are mounted in a bearing housing 21. The stationary radial bearing member 22 has an end surface serving as a stationary thrust sliding surface. The stationary thrust bearing member 23 has an end surface which also serves as a stationary thrust sliding surface. A rotatable thrust bearing member 24 and a thrust collar 25 both serving as rotatable thrust sliding surfaces are disposed one on each side of the stationary radial bearing member 22 and the stationary thrust bearing member 23. The rotatable thrust bearing member 24 is fixed to a thrust disk 26 which is fixed to the main shaft 7 through a dust slinger 27 by a threaded surface and a double nut 28 on one end of the main shaft 7. A spring washer 64 is interposed between the dust singer 27 and the double nut 28.

The bearing housing 21 is inserted in a socket defined in the side frame member 16 with a resilient O-ring 29 interposed therebetween. The bearing housing 21 is held against the side frame member 16 through a resilient gasket 30. A rotatable radial bearing member 31 made of SiC is fixed to the main shaft 7 so as to be rotatable integrally with the main shaft 7 and supported by the radial bearing member 22, the rotatable radial bearing member 31 and the stationary radial bearing member 22 constituting a radial bearing assembly. The relationship between the radial clearance δ between the outer diameter of the thrust collar 25 and the inner diameter of the bearing housing 21 and the radial thickness T of the stationary radial bearing member 22 is arranged to be $\delta \leqq 0.5T$. That is, the radial clearance δ is arranged to be not more than a half of the radial thickness T of the stationary radial bearing member 22.

Further, the relationship between the thickness t of the thrust collar 25 and the distance L from the open end surface of the bearing housing 21 to the inner end of the thrust collar 25 is arranged to be $L \geqq 0.5t$. That is, the distance of not less than a half of thickness t of the thrust collar 25 is inserted into the bearing housing 21.

The thrust collar 25 has a through hole 25*a* extending axially by which the pumped liquid is introduced into the sliding portion of the stationary radial bearing member 22 and the rotatable radial bearing member 31.

Figure 5A:
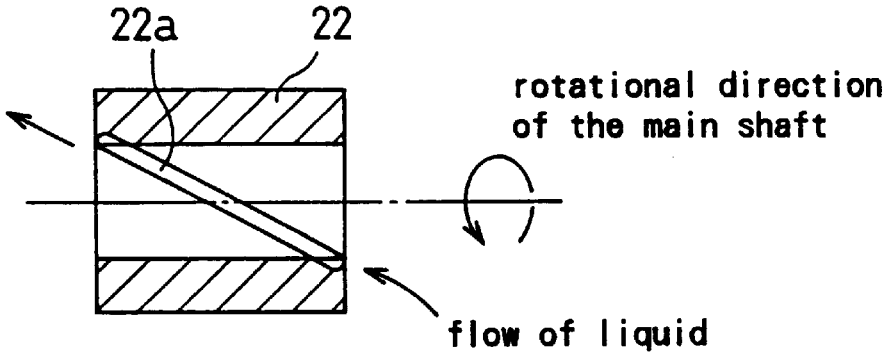
FIG. 5A is a cross-sectional view of a stationary radial bearing member.
Figure 5B:
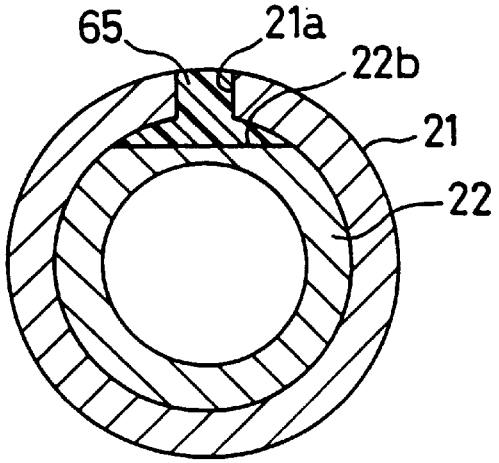
FIG. 5B is a cross-sectional view taken along line V(B)—V(B) of FIG. 4.

As shown in FIG. 5A, the stationary radial bearing member 22 has two spiral grooves 22*a* at the inner circumferential surface thereof so that liquid is supplied into the sliding portion of the stationary radial bearing member 22 and the rotatable radial bearing member 31 by the pumping action of the spiral grooves 22*a*. The stationary radial bearing member 22 has a recess 22*b* at the outer circumferential surface thereof. The bearing housing 21 has a through hole 21*a* at the location corresponding to the recess 22*b* of the stationary radial bearing member 22. As shown in FIG. 5B, resin 65 is injected in the through hole 21*a* and the recess 22*b* and solidified, whereby the stationary radial bearing member 22 is prevented from rotating, with respect to the bearing housing 21. Further, the resin 65 is also provided between the stationary radial bearing member 33 and the bearing housing 32 (see FIG. 3). As shown in FIG. 4, a thrust washer 66 is interposed between the rotatable radial bearing member 31 and the thrust disk 26 so that a key groove 26*a* formed on the thrust disk 26 does not cause cracking or damage of the rotatable radial bearing member 31. The dust slinger 27 is disposed outside the thrust disk 26 and fixed to the main shaft 7. The thrust disk 26 and the dust slinger 27 have respective through holes 26*b* and 27*a* by which the pumped liquid is introduced into the sliding portion of the stationary thrust bearing member 23 and the rotatable thrust bearing member 24.

Figure 5C:
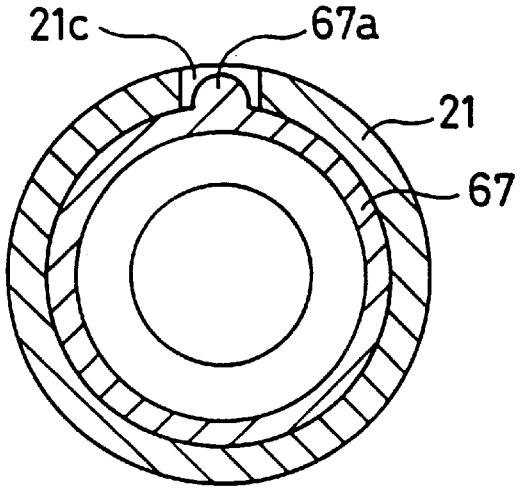
FIG. 5C is a cross-sectional view taken along line V(C)—V(C) of FIG. 4.

An elastic material 67 such as rubber is attached on the respective outer circumferential surfaces of the stationary thrust bearing member 23 and the rotatable thrust bearing member 24 by baking or the like. Since the outer circumferential surfaces of the stationary thrust bearing member 23 and the rotatable thrust bearing member 24 are enclosed by the elastic material 67, forces such as impulse force applied to the stationary thrust bearing member 23 and the rotatable thrust bearing member 24 can be absorbed by the resiliency of the elastic material 67 to thus protect the ceramic thrust bearing members 23, 24. Therefore, the ceramic thrust bearing members 23 and 24 are less susceptible to be cracked or broken. The bearing housing 21 and the thrust disk 26 have respective notches 21*c* and 26*c*. As shown in FIG. 5C, the elastic material 67 has a projection 67*a* which is engaged with the notch 21*c* or 26*c* (only the notch 21*c* is shown in FIG. 5C), whereby the thrust bearing member 23 or 24 is prevented from rotating, with respect to the bearing housing 21 or the thrust disk 26. The stationary thrust bearing member 23 has spiral grooves at the inner surface thereof so that liquid is supplied into the sliding portion of the stationary thrust bearing member 23 and the rotatable thrust bearing member 24 by the pumping action of the spiral grooves.

The full-circumferential-flow in-line pump shown in FIGS. 1 and 2 operates as follows: A fluid drawn from the suction port of the suction-side casing 3 flows into the impeller 8. The fluid is pumped by the impeller 8 and then flows into the impeller 9 through the return blade 47. The fluid is then radially outwardly discharged by the impeller 9, and directed by the guide device 48 to flow axially through the annular fluid passage 40 radially defined between the outer cylinder 2 and the outer frame casing 14. The fluid then flows from the annular fluid passage 40 into the discharge-side casing 4. Thereafter, the fluid is discharged from the discharge port.

In this embodiment, the radial bearing members 33 and 34 made of ceramics such as SiC are enclosed by the bearing housing 32 and the thrust collar 35, and the radial bearing members 22 and 31 made of ceramics such as SiC are enclosed by the bearing housing 21 and the thrust collar 25. Therefore, even if the radial bearing members 22, 31, 33 and 34 are broken, fragments of ceramics are less susceptible to be scattered around. Further, by inserting the thrust collars 25 and 35 into the bearing housings 21 and 32, respectively, scattering of fragments of ceramics is further prevented.

In this embodiment, since the rotatable radial bearing member 34 is fixed to the main shaft 7 using the spring washer 63 and the double nut 36, even if the pump handles high temperature liquid, the rotatable radial bearing member 34 can be securely fixed to the main shaft 7. Further, even if the rotatable radial bearing member 34 is cracked or broken, the double nut 36 is hardly loosened, thus the rotatable radial bearing member 34 does not move axially and fragments thereof are not scattered around.

Further, in this embodiment, the through holes 25*a* and 35*a* are formed in the respective thrust collars 25 and 35 facing the stationary radial bearing members 22 and 33, respectively so that the pumped liquid is supplied to the sliding portion of the radial bearing members. Thus, the sliding surfaces between the radial bearing members are sufficiently lubricated. In the case where the main shaft 7 extends vertically and the pump is vertically installed, air is hardly accumulated at the location around the main shaft 7 of the pump, and the bearings are prevented from being broken due to poor lubrication.

According to the present invention, the elastic material 67 such as rubber is attached to the respective thrust bearing members 23 and 24 made of ceramics such as SiC by baking or the like, thereby enabling the thrust bearing members 23 and 24 and the elastic material 67 to be an integral component, respectively. The thrust bearing members 23 and 24 are inserted into the bearing housing 21 and the thrust disk 26, respectively, therefore the rubber 67 and the inner surface of the bearing housing 21 or the thrust disk 26 contact with each other firmly and widely. Therefore, the ceramic thrust bearing members 23 and 24 are less susceptible to be cracked or broken by force absorbing action of the elastic material 67, and are also prevented from rotating with respect to the bearing housing 21 and the thrust disk 26, respectively.

Further, the projection 67*a* of the rubber 67 is engaged with the recess 21*c* to prevent the thrust bearing member 23 from rotating, with respect to the bearing housing 21, and the projection 67*a* is engaged with the recess 26*c* to rotate the thrust bearing member 24 together with the thrust disk 26. This structure enhances further prevention of rotating of the thrust bearing members 23 and 24, with respect to the holding member.

Further, according to the present invention, the washer 66 is interposed between the thrust disk 26 and the rotatable radial bearing member 31 so that the key groove 26*a* does not contact directly the ceramic radial bearing member 31, thereby preventing the ceramic radial bearing member from being cracked or broken.

As apparent from the above description, according to the present invention, the bearing device is less susceptible to be damaged or broken and can eliminate a problem of secondary concern even if it is broken. To be more specific, the present invention offers the following advantages:

(1) The bearing device is prevented from being broken by maintaining good lubrication of sliding surfaces, and even if it is broken, the pump incorporating such bearing device is prevented from being damaged.

(2) Ceramics such as SiC is prevented from being mixed in liquid handled by the pump.

(3) Repair is completed only by replacing the bearing device, and other components are not required to be repaired.

(4) The bearing device made of ceramics can be prevented from rotating, with respect to the holding member using a rotation preventing member made of elastic material.

Although certain preferred embodiments of the present invention have been shown and described in detail, it should be understood that various changes and modifications may be made therein without departing from the scope of the attended claims.

What is claimed is:

1. A bearing device for use in a pump having a bearing assembly for supporting a rotating body, the rotating body having a shaft, comprising:

a bearing housing;

a stationary bearing member formed of a brittle material and housed in said bearing housing and supporting said shaft, said stationary bearing member having an outer diameter which substantially corresponds to an inner diameter of said bearing housing; and a thrust collar fixed to said shaft and receiving a thrust force, said thrust collar being located inside said bearing housing;

wherein said bearing housing and said thrust collar are provided so as to enclose said stationary bearing member.

2. The bearing device according to claim 1, wherein said first means comprises an elastic material provided around an outer circumferential surface of said stationary bearing member.

3. The bearing device according to claim 2, wherein said elastic material has a projection at an outer surface thereof, and said bearing housing has a notch at the location corresponding to said projection so that said projection is engaged with said notch.

4. The bearing device according to claim 1, wherein said stationary bearing member comprises one of a stationary radial bearing member and a stationary thrust bearing member.

5. The bearing device according to claim 4, wherein the relationship between a radial clearance $\delta$ between an outer diameter of said thrust collar and an inner diameter of said bearing housing and the radial thickness T of said stationary radial bearing member is arranged to be $\delta \leqq 0.5T$.

6. The bearing device according to claim 4, wherein the relationship between an axial thickness t of said thrust collar and a distance L from an open end surface of said bearing housing to an inner end of said thrust collar is arranged to be $L \geqq 0.5t$.

7. The bearing device according to claim 1, wherein said thrust collar has a through hole forming a liquid passage capable of introducing liquid in the pump into a sliding portion of said bearing member.

8. The bearing device according to claim 1, wherein said stationary bearing member has a groove at the inner circumferential surface thereof to allow liquid in the pump to pass therethrough.

9. The bearing device according to claim 1, wherein a radial clearance $\delta$ between an outer diameter of said thrust collar and an inner diameter of said bearing housing is sufficiently narrow to substantially prevent scattering of broken pieces of the stationary bearing member.

10. A bearing device for use in a pump having a bearing assembly for supporting a rotating body, the rotating body having a shaft, comprising:

a bearing housing;

a stationary bearing member formed of a brittle material and housed in said bearing housing and supporting said shaft, said stationary bearing member having an outer diameter which substantially corresponds to an inner diameter of said bearing housing; and a rotatable bearing member fixed to said shaft so as to be rotatable with said shaft;

wherein said rotatable bearing member comprises a rotatable radial bearing member having a coefficient of linear thermal expansion smaller than that of said shaft, said rotatable radial bearing member is in sliding contact with said stationary bearing member, and said rotatable radial bearing member is fixed to said shaft by means including a double nut for absorbing dimensional tolerances along the axis of the shaft.

11. The bearing device according to claim 10, wherein said rotatable bearing member comprises a rotatable thrust bearing member, said rotatable thrust bearing member is held by a thrust disk, and at least of one said rotatable thrust bearing member and said thrust disk has a through hole forming a liquid passage capable of introducing liquid in the pump into a sliding portion of said rotatable bearing member.

12. The bearing device according to claim 11, wherein said thrust disk is fixed to said shaft by a key, and a washer is provided between said thrust disk and said rotatable bearing member.

13. A pump having a bearing device, comprising:

a pump casing;

a canned motor in said pump casing, said canned motor comprising:

a motor frame housing a stator;

a rotor rotatably supported by said motor frame and including a shaft having axially opposite end portions; and a bearing device disposed on one of said axially opposite end portions of said shaft, said bearing device comprising:

a bearing housing;

a stationary bearing member formed of a brittle material and housed in said bearing housing and supporting said shaft, said stationary bearing member having an outer diameter which substantially corresponds to an inner diameter of said bearing housing; and a thrust collar fixed to said shaft and receiving a thrust force, said thrust collar being located inside said bearing housing, wherein said bearing housing and said thrust collar are provided so as to enclose said stationary bearing member.

14. The pump according to claim 13, wherein said first means comprises an elastic material provided around an outer circumferential surface of said stationary bearing member.

15. The pump according to claim 14, wherein said elastic material has a projection at an outer surface thereof, and said bearing housing has a notch at the location corresponding to said projection so that said projection is engaged with said notch.

16. The pump according to claim 13, wherein said stationary bearing member comprises one of a stationary radial bearing member and a stationary thrust bearing member.

17. The pump according to claim 16, wherein the relationship between a radial clearance $\delta$ between an outer diameter of said thrust collar and an inner diameter of said bearing housing and the radial thickness T of said stationary radial bearing member is arranged to be $\delta \leqq 0.5T$.

18. The pump according to claim 16, wherein the relationship between an axial thickness t of said thrust collar and a distance L from an open end surface of said bearing housing to an inner end of said thrust collar is arranged to be $L \geqq 0.5t$.

19. The pump according to claim 13, wherein said thrust collar has a through hole forming a liquid passage capable of introducing liquid in the pump into a sliding portion of said bearing member.

20. The pump according to claim 13, wherein said stationary bearing member has a groove at the inner circumferential surface thereof to allow liquid in the pump to pass therethrough.

21. The bearing device according to claim 13, wherein a radial clearance $\delta$ between an outer diameter of said thrust collar and an inner diameter of said bearing housing is sufficiently narrow to substantially prevent scattering of broken pieces of the stationary bearing member.

22. A pump having a bearing device, comprising:

a pump casing;

a canned motor in said pump casing, said canned motor comprising:

a motor frame housing a stator;

a rotor rotatably supported by said motor frame and including a shaft having a pair of axially opposite end portions; and a bearing device disposed on one of said axially opposite end portions of said shaft, said bearing device comprising:

a bearing housing;

a stationary bearing member formed of a brittle material and housed in said bearing housing and supporting said shaft, said stationary bearing member having an outer diameter which substantially corresponds to an inner diameter of said bearing housing; and a rotatable bearing member fixed to said shaft so as to be rotatable with said shaft;

wherein said rotatable bearing member comprises a rotatable radial bearing member having a coefficient of linear thermal expansion smaller than that of said shaft, said rotatable radial bearing member is in sliding contact with said stationary bearing member, and said rotatable radial bearing member is fixed to said shaft by means including a double nut for absorbing dimensional tolerances along the axis of the shaft.

23. The pump according to claim 28, wherein said rotatable bearing member comprises a rotatable thrust bearing member, said rotatable thrust bearing member is held by a thrust disk, and at least one said of rotatable thrust bearing member and said thrust disk has a through hole forming a liquid passage capable of introducing liquid in the pump into a sliding portion of said rotatable bearing member.

24. The pump according to claim 23, wherein said thrust disk is fixed to said shaft by a key, and a washer is provided between said thrust disk and said rotatable bearing member.

* * * * *